US011981465B2

(12) United States Patent
Wallenius et al.

(10) Patent No.: US 11,981,465 B2
(45) Date of Patent: May 14, 2024

(54) METHOD FOR COMPRESSING STRUCTURED TISSUES

(71) Applicant: Essity Hygiene and Health Aktiebolag, Gothenburg (SE)

(72) Inventors: Hans Wallenius, Gothenburg (SE); Ingela Ljusegren, Gothenburg (SE)

(73) Assignee: ESSITY HYGIENE AND HEALTH AKTIEBOLA, Gothenburg (SE)

( * ) Notice: Subject to any disclaimer, the term of this patent is extended or adjusted under 35 U.S.C. 154(b) by 710 days.

(21) Appl. No.: 17/055,469

(22) PCT Filed: May 15, 2018

(86) PCT No.: PCT/EP2018/062463

§ 371 (c)(1),
(2) Date: Nov. 13, 2020

(87) PCT Pub. No.: WO2019/219168

PCT Pub. Date: Nov. 21, 2019

(65) Prior Publication Data

US 2021/0221544 A1 Jul. 22, 2021

(51) Int. Cl.
*B65B 25/14* (2006.01)
*B65B 63/02* (2006.01)
(Continued)

(52) U.S. Cl.
CPC ..... *B65B 25/145* (2013.01); *B65B 63/02* (2013.01); *D21H 27/002* (2013.01); *D21H 27/02* (2013.01);
(Continued)

(58) Field of Classification Search
CPC ..... B65B 25/145; B65B 27/08; B65B 63/02; B65B 63/04; B65H 2301/4223;
(Continued)

(56) References Cited

U.S. PATENT DOCUMENTS 3,172,564 A * 3/1965 Enloe et al. ..... B65H 45/24 221/48
3,710,536 A * 1/1973 Lee et al. ..... B65B 27/08 53/399
(Continued)

FOREIGN PATENT DOCUMENTS

AU 2018423670 A1 11/2020
CN 101981254 A 2/2011
(Continued)

OTHER PUBLICATIONS

Search Report and Written Opinion dated Jul. 21, 2022, by the Brazilian Patent Office in corresponding Brazilian Patent Application No. BR112020021561-9. (4 pages).
(Continued)

*Primary Examiner* — Stephen F. Gerrity
(74) *Attorney, Agent, or Firm* — BUCHANAN INGERSOLL & ROONEY PC

(57) ABSTRACT

A method and apparatus are disclosed for processing structured tissue material to form a compressed bundle of folded tissues. A web of at least one ply of structured tissue is subjected to a destructuring operation before folding with itself or with another similar web to form a stack. The stack can then be compressed to form the compressed bundle at a pressure that is less than would have been the case, had the structured tissue not first been destructured.

15 Claims, 2 Drawing Sheets

(51) Int. Cl.
*D21H 27/00* (2006.01)
*D21H 27/02* (2006.01)

(52) U.S. Cl.
CPC ..... *B65H 2301/4223* (2013.01); *B65H 2701/18271* (2013.01); *B65H 2701/1924* (2013.01)

(58) Field of Classification Search
CPC .. B65H 2701/18271; B65H 2701/1924; D21H 27/002; D21H 27/02
USPC ..... 53/429, 435, 438, 117, 520, 529
See application file for complete search history.

(56) References Cited

U.S. PATENT DOCUMENTS

| | | | | |
|---|---|---|---|---|
| 5,088,975 | A * | 2/1992 | Ghilardi | B65H 45/221 270/41 |
| 5,853,547 | A | 12/1998 | Ahrens et al. | |
| 6,077,390 | A | 6/2000 | Salman et al. | |
| 7,527,709 | B2 | 5/2009 | Lippi et al. | |
| 7,550,061 | B2 | 6/2009 | Walkenhaus et al. | |
| 7,744,726 | B2 | 6/2010 | Scherb et al. | |
| 10,085,600 | B2 * | 10/2018 | Shiinoki et al. | D21H 27/002 |
| 10,602,886 | B2 | 3/2020 | Wellenius et al. | |
| 2005/0247416 | A1 * | 11/2005 | Forry et al. | D04H 13/00 162/158 |
| 2011/0027545 | A1 | 2/2011 | Harlacher et al. | |
| 2011/0129633 | A1 * | 6/2011 | Andersson | B65H 45/24 428/130 |
| 2012/0255671 | A1 | 10/2012 | Wallstabe et al. | |
| 2013/0026989 | A1 | 1/2013 | Gibbs et al. | |
| 2013/0269893 | A1 * | 10/2013 | Nelvig et al. | D21H 5/00 162/111 |
| 2015/0298420 | A1 | 10/2015 | Gungner et al. | |
| 2015/0330030 | A1 * | 11/2015 | Dwiggins | A47K 10/16 162/109 |
| 2019/0218718 | A1 * | 7/2019 | Lewis et al. | D21H 17/67 |
| 2021/0221544 | A1 | 7/2021 | Wallenius et al. | |

FOREIGN PATENT DOCUMENTS

| | | | | | |
|---|---|---|---|---|---|
| CN | 102666990 | A | | 9/2012 | |
| CN | 103281943 | A | | 9/2013 | |
| CN | 104822520 | A | | 8/2015 | |
| CN | 107635877 | A | | 1/2018 | |
| EP | 1156925 | B1 | | 4/2006 | |
| EP | 3793905 | B1 | | 9/2021 | |
| JP | 10179441 | A | * | 7/1998 | |
| KR | 20150015157 | A | * | 2/2015 | D21H 27/002 |
| SU | 825370 | A1 | | 4/1981 | |
| WO | 2006041435 | A1 | | 4/2006 | |
| WO | 2012087211 | A1 | | 6/2012 | |
| WO | 2016049338 | A1 | | 3/2016 | |
| WO | 2016209123 | A1 | | 12/2016 | |
| WO | 2019219168 | A1 | | 11/2019 | |

OTHER PUBLICATIONS

International Preliminary Report on Patentability (Form PCT/IB/373) and the Written Opinion of the International Searching Authority (Form PCT/ISA/237) dated Nov. 17, 2020, by the International Bureau of WIPO, in corresponding International Application No. PCT/EP2018/062463. (7 pages).

Office Action dated Apr. 14, 2022, by the Chilean Patent Office in Chilean Patent Application No. 2020-002934, with Partial English Language Machine Translation. (25 pages).

Office Action dated Jan. 11, 2022, by the Canadian Intellectual Property Office in Canadian Patent Application No. 3,097,452 (3 pages).

Office Action (Notification of the First Office Action) dated Sep. 27, 2021 by the China National Intellectual Property Administration (CNIPA) of the People's Republic of China in corresponding Chinese Patent Application No. 201880093118.X, and an English Translation of the Office Action. (19 pages).

International Search Report (PCT/ISA/210) dated Oct. 11, 2018, by the European Patent Office as the International Searching Authority for International Application No. PCT/EP2018/062463.

Written Opinion (PCT/ISA/237) dated Oct. 11, 2018, by the European Patent Office as the International Searching Authority for International Application No. PCT/EP2018/062463.

Office Action dated Jun. 24, 2022, by the Colombian Patent Office in corresponding Colombian Patent Application No. NC2020/0014000, and an English Translation of the Office Action. (17 pages).

Office Action dated Mar. 11, 2021, by the Federal Service for Intellectual Property in Russian Patent Application No. 2020141036/11(076321) and an English Translation of the Office Action. (11 pages).

Office Action dated Dec. 12, 2023, by the Indian Patent Office in corresponding Indian Patent Application No. 202017047840. (2 pages).

Janda, Bruce W., "Sheet Structure Process Effect on Tissue Properties", Tappi Tissue 360, 2015, pp. 16-23.

* cited by examiner

METHOD FOR COMPRESSING STRUCTURED TISSUES

TECHNICAL FIELD

The present disclosure relates to a method of handling structured tissues, in particular, the type of tissues that are provided as a stack of folded individual tissues for use in dispensers. The disclosure relates in particular to a method for processing such tissues to form compressed tissue bundles, the apparatus for performing the method and the resulting bundles.

BACKGROUND ART

Stacks of absorbent tissue paper material are used for providing web material to users for wiping, drying and or cleaning purposes. Conventionally, the stacks of tissue paper material are designed for introduction into a dispenser, which facilitates feeding of the tissue paper material to the end user. Also, the stacks provide a convenient form for transportation of the folded tissue paper material. To this end, the stacks are often provided with a packaging, to maintain and protect the stack during transport and storage thereof.

Accordingly, packages are provided comprising a stack of tissue paper material, and a corresponding packaging. During transportation of packages containing tissue paper material, there is a desire to reduce the bulk of the transported material. Typically, the volume of a package including a stack of tissue paper material includes substantial amounts of air between panels and inside the panels of the tissue paper material. Hence, substantial cost savings could be made if the bulk of the package could be reduced, such that greater amounts of tissue paper material may be transported, e.g., per pallet or truck.

Also, when filling a dispenser for providing tissue paper material to users there is a desire to reduce the bulk of the stack to be introduced into the dispenser, such that a greater amount of tissue paper material may be introduced in a fixed housing volume in a dispenser. If a greater amount of tissue paper material may be introduced into a dispenser, the dispenser will need refilling less frequently. This provides cost saving opportunities in view of a diminished need for attendance of the dispenser.

An example of the field to which the present disclosure relates is found in WO2012/087211, the content of which is incorporated herein by reference in its entirety.

This document explains in detail the desire and advantages relating to increased compression of tissue stacks, the various tissue materials to which it is applicable and the relevant methods of folding and interleaving. It also describes a number of ways of compressing tissue bundles. In certain embodiments it proposes inclined belts or rollers which gradually compact a stack of tissues as they progress along a path in a continuous process. In other embodiments, one or more stacks may be compressed between plates in a batch process. Nevertheless, although it teaches that such stacks may be compressed to relatively high densities, it fails to identify certain problems that are associated with certain tissue types on attempting to compress the stack beyond the previously accepted pressure values.

In particular, while some tissues such as dry-crepe tissues can be readily compressed to a desired high density suitable for transport and distribution logistics, achieving similar densities with structured tissues may require significantly higher pressures. In certain cases, the pressure required to reach a given density for structured tissue may be double the pressure required for a similar weight of dry-crepe tissue. This may be beyond the capabilities of existing compression stations, requiring a re-engineering of the compression station. For a conversion machine that can operate with different qualities of tissue including structured tissue, this may lead to a compression station that is much more expensive and will be over-engineered for most other tissues.

SUMMARY

According to an embodiment of the present invention, a method is disclosed for processing structured tissue material to form a compressed bundle of folded tissues, the method comprising: providing a web comprising at least one ply of structured tissue; at least partially destructuring the web; subsequently folding the web with itself or with another similar web to form a stack; and compressing the stack at a compression of greater than 120 kN/m$^2$ to form the compressed bundle of folded tissues having a density of greater than 0.2 g/cm$^3$. It has been found that by subjecting the web to a process of destructuring, a significant reduction in the force required to compress the stack may be achieved. Importantly, this reduced force does not appear to come at the expense of tissue quality and the resulting tissue appears to largely retain all of the qualities of conventional structured tissue.

The degree to which the stack is compressed will depend upon the end product required, the compression station construction and also on the nature of the tissue. In conventional machines, the stack may be compressed at pressures of greater than 200 kN/m$^2$ or greater than 275 kN/m$^2$. It is of course not excluded that more robust machines may compress the stack at greater than 500 kN/m$^2$ or even up to 600 kN/m$^2$ but less than 800 kN/m$^2$.

The resulting density will also depend on the degree of compression and also on the type and weight of tissue being compressed. In the following all values are given for virgin fibres. The skilled person will appreciate that for recycled fibres and blends, the values will vary accordingly. The density of the compressed bundle may be greater than 0.2 g/cm$^3$ but may also be greater than 0.24 g/cm$^3$ or greater than 0.3 g/cm$^3$ or even greater than 0.4 g/cm$^3$. An upper limit of density will depend on the particular tissue but may be up to 0.5 g/cm$^3$.

Destructuring may take place by any suitable means capable of reducing the resistance to compression of the structured tissue. In one embodiment, destructuring of the tissue may take place by calendering and/or embossing of the tissue over its full surface area. Without wishing to be bound by theory, it is believed that the calendering and/or embossing causes partial destructuring of the structured tissue. This can be chosen to be just sufficient to allow for compression of the tissue bundle without significantly affecting the touch and feel of the tissue product.

In the case of embossing, the amount of embossing required may depend upon the tissue being processed. For the avoidance of doubt, the embossing referred to in the present specification is micro-embossing i.e. a fine embossing pattern that is distributed over the whole surface at an area density of from 10 to 100 dots per cm$^2$. Preferred embossing patterns are at an area density of either 40, 60 or 80 dots per cm$^2$, sometimes referred to as Micro 40, Micro 60 and Micro 80. This is distinct from macro-embossing, which may be applied e.g. to provide a local or repeating visual pattern.

The degree of embossing may be adjusted in order to ensure that the pressure in a subsequent compression step required to achieve the desired density is within acceptable limits. The tissue may be subjected to a low, medium or high degree of embossing, whereby the degree of embossing will be referred to as the local pressure exerted by an embossing element i.e. the structure that forms the dot. The exact value can be calculated and will depend on a number of variables including the number of dots, the area of each element, the nip length and the line pressure between the rollers, the diameter of the cylinders and, in the case of a rubber cylinder, the hardness. In the following, a low degree of embossing refers to pressures of from 10 000 to 15 000 $N/mm^2$, medium embossing is for pressures of from 15 000 $N/mm^2$ to 25 000 $N/mm^2$ and a high degree of embossing refers to pressures of from 25000 $N/mm^2$ to 45000 $N/mm^2$. This pressure is calculated as the line pressure divided by the by the nip length. From this total area the pressure created by the dots are calculated (i.e., number of dots×dot area). It will be understood that this is an approximate value since cylinders are round whereby the pressure may vary along the nip. Also, in the case of steel-rubber deflection of the rubber may change the actual contact area.

In an embodiment, the embossed tissue has a nominal thickness that is the same or slightly lower by 5-10%, than prior to embossing. Embossing may be double-sided and may take place on metal-to-metal embossing cylinders or single sided between metal and rubber cylinders.

The degree of calendering may also be determined according to the type of tissue. In particular, the degree of calendering may be adjusted to ensure that the pressure in a subsequent compression step required to achieve the desired density is within acceptable limits. Calendering and embossing may take place in any sequence. Nevertheless, it has been found that a process whereby embossing is followed by calendering provides a significantly softer result than is the case for tissue that has not been subjected to such treatment or that has been first calendered and then embossed. The calendered tissue may have a nominal thickness that is from 33-80% less thick than prior to embossing. Calendering in this case is done by setting a fixed gap or nip between the calender rollers and depending on paper thickness different nip pressure will occur. The degree of calendering may be low, medium or high with a nip of from 0.2 to 0.1 mm being a low degree, a nip of from 0.1 to 0.02 mm being a medium degree and a nip of 0.02 to 0.005 mm being a high degree of calendering. Particularly acceptable results have been encountered when medium or high embossing is combined with low to medium calendering.

Following the destructuring of the tissue web, it may be necessary to carry out further steps prior to folding of the web. In one embodiment, wrinkles in the tissue due to the destructuring may need to be removed. This may be achieved using conventional spreaders such as brushes or a Mount Hope roller. In an embodiment including embossing, the spreader may be located downstream of the embossing roller and preferably upstream of the calender if present.

The compression of the bundle may in particular be carried out in a continuous process. By ensuring movement of the stack along the transport path during compression, the stack can be integrated into a production line. First and second compression members may be provided, which compress the bundle as it travels along a compression path. In an embodiment, first and second transport surfaces may be provided on the compression members e.g. in the form of conveyor belts carried by the first and second compression members. The method may comprise driving the conveyor belts to transport the stack along the compression path. By driving the transport surfaces in engagement with the stack, it may be ensured that the upper and lowermost tissues experience no relative movement as they are compressed with respect to the transport surface which actually performs the compression.

The compressed bundle may be referred to as a log, due to its high degree of compaction. The method may also comprise wrapping the log in a web or webs to maintain the compression after leaving the compression path. This may comprise delivering the log from the compression path to a bander apparatus and wrapping it in wrapping web. The bander apparatus may be largely conventional although designed to operate at high compression. One bander apparatus is described in WO06041435, the contents of which are hereby incorporated by reference in their entirety. The web material may be adhered to itself by any appropriate means, including adhesive, heat sealing or additional elements such as tape and must be strong enough to withstand the spring-back pressure exerted by the log. To this end, high-tensile paper such as virgin-pulp based paper having a weight of at least 70 gsm, preferably at least 90 gsm and even over 100 gsm and a tensile strength in a height direction of the stack of at least 3.5 kN/m, preferably at least 4.5 kN/m, most preferred at least 5.5 kN/m.

The bander apparatus may be engaged directly with the outlet end of the compression path. Preferably, it maintains the log at a compression corresponding to that at the outlet end of the compression path, thus increasing the period of compression. The bander apparatus may be provided with conveyor belts for transporting the log through the bander apparatus with the conveyor belts having a spacing corresponding to the second spacing of the first and second compression members. It will be understood that this spacing may be adjusted as required, depending on whether it is desired to increase or decrease the compression of the log during wrapping. The log may be transported through the bander apparatus at a constant speed, which may correspond to the speed through the compression path. It may also be desirable to include a holding station that retains the pressure on the log even after the wrapping is completed. In one embodiment, the bander apparatus, including the holding station has a length of greater than 3 metres, preferably greater than 4 metres and even greater than 5 metres or up to 10 metres, to ensure adequate time for the log to pass through the bander apparatus under the desired pressure.

The method may further comprise cutting the log e.g. by sawing, into a plurality of individual tissue bundles. A typical log will have a length of more than 1.5 meters, typically from around 1.8 meters to 2.6 meters and may be cut into from 8 to 15 individual bundles, although it will be understood that this will depend upon the actual width of tissue required. The step of cutting may take place subsequent to wrapping the log although it is not excluded that the log is first cut and then wrapped. This step may also take place in a continuous process or in a batch process (one log at a time) or an incremental process (one bundle at a time).

As indicated above, the method allows bundles of folded structured tissue to be compressed to a desired density with much less force than previously required. These pressures are nevertheless still very high and may compress the tissue to close to the limits that can be achieved without denaturing the product. It will be noted that the pressure values quoted above and further below are calculated average values based on the machine construction and the forces encountered at the machine. Actual values encountered within the tissue will be transitory during the process and may vary from these averaged values.

The pressures referenced above for the compression of the bundle may be maintained for a considerable period of time as the bundle proceeds through the compression path and or any subsequent holding station that retains the pressure. In certain embodiments the pressure may be maintained for at least 2 seconds for any particular portion of the bundle or log. Depending upon the length of the compression path and/or holding station, the pressure may be maintained for at least 4 seconds or more than 6 seconds or more than 8 seconds or up to 20 seconds.

The method is applicable to any sort of structured tissue that may require compression or wrapping as herein described. It is however particularly applicable to structured tissues that are intended for use in bulk tissue dispensers. The term "tissue" is herein to be understood as a soft absorbent paper having a basis weight below 65 gsm, in particular between 10 gsm and 65 gsm, preferably between 15 gsm and well below 0.30 g/cm$^3$, preferably between 0.08 and 0.20 g/cm$^3$. The fibres contained in the tissue are mainly pulp fibres from chemical pulp, mechanical pulp, thermo-mechanical pulp, chemo-mechanical pulp and/or chemo-thermo-mechanical pulp (CTMP). The tissue may also contain other types of fibres enhancing, e.g., strength, absorption or softness of the paper. The absorbent tissue material may include recycled or virgin fibres or a combination thereof.

Structured tissue in the present context refers to a three-dimensionally structured tissue paper web. The structured tissue material may be a TAD (Through-Air-Dried) material, a UCTAD (Uncreped-Through-Air-Dried) material, an ATMOS (Advanced-Tissue-Molding-System), an NTT material (New Tissue Technology from Valmet Technologies) or a combination of any of these materials.

Optionally, the web comprises further plies of tissue material, preferably at least one further ply of structured tissue and/or a ply of a dry crepe material. In the latter case, the web of tissue paper material may be referred to as hybrid tissue. In the present disclosure, this is defined as a combination material comprising at least one ply of a structured tissue paper material and at least one ply of a dry crepe material. Preferably, the ply of a structured tissue paper material may be a ply of TAD material or an ATMOS material. In particular, the combination may consist of structured tissue material and dry crepe material, preferably consist of one ply of a structured tissue paper material and one ply of a dry crepe material, for example the combination may consist of one ply of TAD or ATMOS material and one ply of dry crepe material. An example of TAD is known from US 5 5853 547; ATMOS from U.S. Pat. Nos. 7,744,726, 7,550,061 and 7,527,709; and UCTAD from EP 1 156 925.

The plies may be combined in the converting machine, before during or after the destructuring process. In one embodiment, the plies are brought together after the destructuring has taken place but prior to folding. Combining the plies may involve local embossing and adhesive application followed by passage through marrying rollers. These steps are thus understood to be in addition to the destructuring steps described elsewhere.

Optionally, a combination tissue web may include other materials than those mentioned in the above, such as for example a nonwoven material. Alternatively, the tissue web may be free from nonwoven material.

The tissue may be compressed from an initial density in the stack to a final density in the log. In the following reference to the final density is understood to be the density of a wrapped log after spring back against the wrapper has occurred. The stack may thus be compressed to a slightly higher density and on relaxing against the wrapper, will assume a slightly lower density. The compressed density at the termination of the compression step may be 4% to 40% higher than the wrapped density after spring-back, depending upon the arrangement and effectiveness of the wrapping operation. In one embodiment, this over-compression may be around 15-25%.

The final density will also depend upon the sort of tissue that is being packaged. In one embodiment, the tissues are of structured tissue and the final density is greater than 0.2 g/cm$^3$ or greater than 0.24 g/cm$^3$ or greater than 0.3 g/cm$^3$ or even greater than 0.4 g/cm$^3$ or up to 0.5 g/cm$^3$. In another embodiment, the tissues are of hybrid tissue and the final density is greater than 0.2 g/cm$^3$ or greater than 0.24 g/cm$^3$ or greater than 0.3 g/cm$^3$ or even greater than 0.4 g/cm$^3$ or up to 0.5 g/cm$^3$.

In one embodiment, the stack is compressed to a log having a height that is less than 70% of the initial stack, preferably less than 60% and optionally even less than 50% of the initial loose stack.

As indicated above, the invention is particularly applicable to tissues for use in bulk dispensers. The method may provide for separating the web into individual tissue sheets by cutting prior to or during folding of the web. In an embodiment, the web is partially cut or perforated into sheets prior to being folded. The partial separation can assist the dispensing operation by ensuring that the respective webs of tissue are dispensed continuously.

The folded tissues may be provided in any appropriate format as required by the end user. Most typically, the folded tissues will be interleaved, in order to facilitate dispensing. They may be interleaved in a V, M or Z configuration. In a particular embodiment, the tissue is present as two continuous webs provided with offset perforations whereby tissues are dispensed alternately from each web.

The method may be carried out in a machine operable with a web having a width of between 1.5, and 2.5 m, which will define the length of the bundle. Folding of the web may be arranged to achieve a stack with a width of between 70 mm and 100 mm, preferably between 80 mm and 90 mm. This width may correspond to the width of the final compressed bundle although it will be understood that a slight increase may occur during compression.

Furthermore, it will be understood that the various steps of the method may be spaced from each other both temporally and spatially. In one embodiment, embossing, calendering and folding take place in a tissue conversion machine in a continuous process and the stack is subsequently delivered to a compression station for compression of the stack. The method may further comprise delivering the compressed bundle to a bander station and wrapping the bundle in a wrapping web to form a wrapped bundle, wherein the bander station may be directly adjacent and/or connected to the compression station or at a distance therefrom.

The invention also relates to a tissue package, preferably manufactured as described above or hereinafter, the tissue package comprising a plurality of folds of embossed and calendered, structured tissue enveloped in a wrapping web, the package having a density of greater than 0.2 g/cm$^3$ or greater than 0.24 g/cm$^3$ or greater than 0.3 g/cm$^3$, or even greater than 0.4 g/cm$^3$ and wherein the pressure exerted on the wrapping web is less than 200 kN/m$^2$. As discussed above, as a result of the processing of the structured tissue prior to compression, it is possible to achieve the required high-compression, high-density package with lower compression than would otherwise be required. This lower compression is also manifested in the lower spring back pressure of the tissue on the wrapping, meaning that the wrapping web may also be lighter than would be required if embossing and calendering had not been performed.

Furthermore, on release of the wrapping web, the tissue may recover to form a stack having a height that is at least 50%, or alternatively at least 70% and preferably at least 80% greater than the height of the wrapped package. This expansion may not be immediate but may be determined after a period of release of more than 1 hour or more than 4 hours or more than 24 hours. This expansion is a useful measure of the fact that the tissue is still viable and has not been completely destructured.

The tissue may be a single ply of structured tissue or may comprise two or multiple plies of structured tissue or a mixture of structured tissue with one or more plies of other tissue. In a particular embodiment, the tissue is hybrid tissue comprising plies of dry crepe and structured tissue.

The tissue package may comprise a wrapping web of high-tensile paper having a tensile strength in a height direction of the stack of at least 3.5 kN/m, preferably at least 4.5 kN/m, most preferred at least 5.5 kN/m. Various paper qualities and weights may be used as described above but it will be understood that a high degree of virgin pulp may be desirable including more than 80% virgin pulp or even 100% virgin pulp. The wrapper may be a two part wrapper or a one-part wrap-around wrapper could alternatively be used.

The invention also relates to a tissue conversion apparatus for converting a tissue web of structured tissue into folded tissue bundles, the apparatus comprising: an embossing station; a calendering station; a folding station; a compression station; and a wrapping station, wherein the apparatus is arranged to pass the web through the embossing station and the calendering station to the folding station for forming a folded tissue bundle and the compression station is arranged to compress the stack at a compression of greater than 120 kN/m$^2$ to form a compressed bundle of folded tissues having a density of greater than 0.2 g/cm$^3$.

The apparatus may also comprise a controller adapted to control operation of the apparatus to perform the method described above or hereinafter. The controller may provide for the co-ordination of the respective movements to ensure the desired results based on feedback from appropriate sensors.

Other advantages and distinctions of embodiments of the present invention over existing methods and products will be apparent in the light of the following detailed description.

BRIEF DESCRIPTION OF THE DRAWINGS

The present invention will be discussed in more detail below, with reference to the attached drawings, in which.

DESCRIPTION OF EMBODIMENTS

Figure 1:
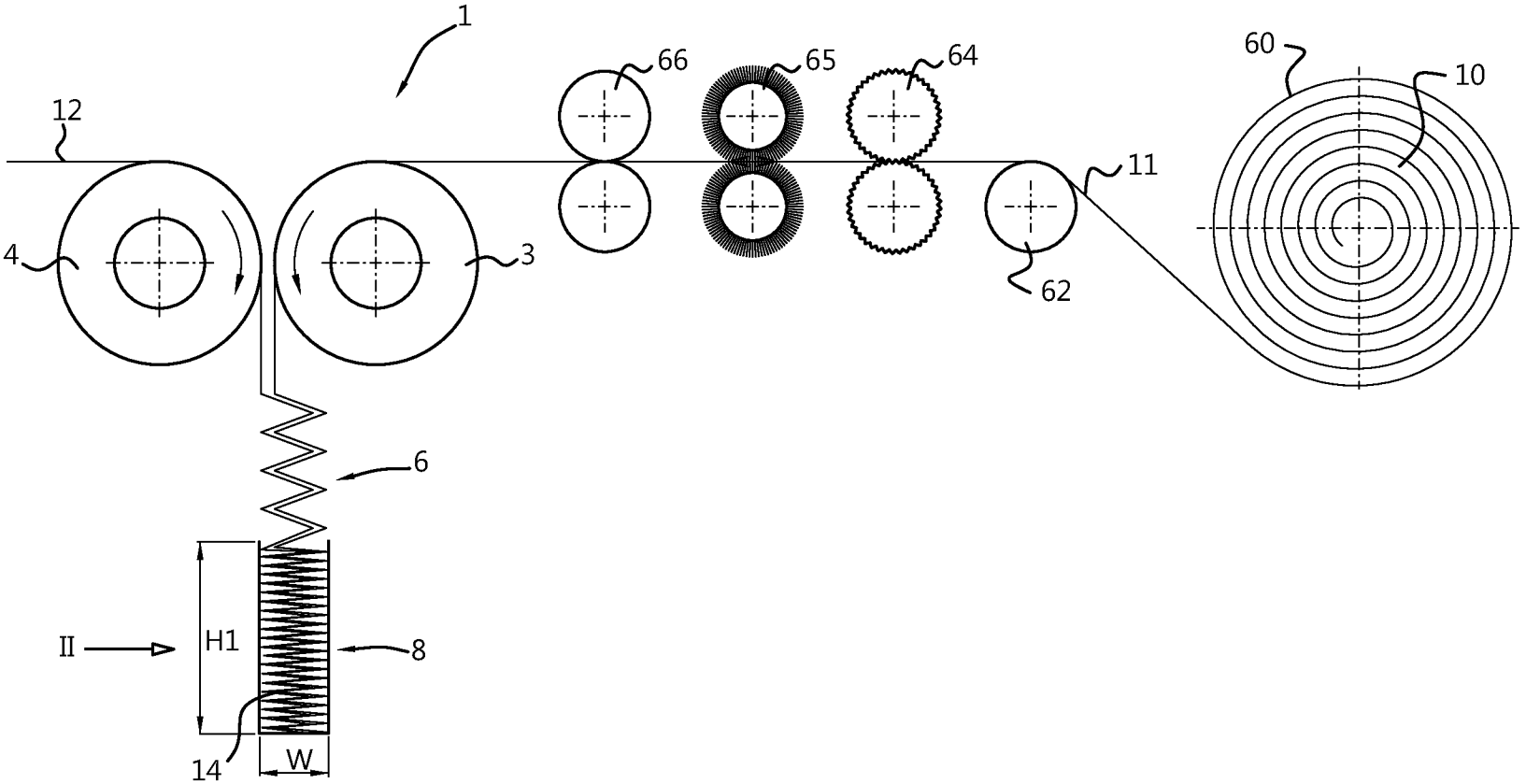
FIG. 1 is a schematic side view of part of a tissue conversion machine according to the present invention.

FIG. 1 is a schematic side view onto part of a tissue converting machine 1 that may be used according to the present invention. In this embodiment, the converting machine 1 is described during the production of single ply structured tissue 10. The skilled person will nevertheless understand that other structured tissue types and weights may also be used. For the sake of convenience only the right-hand half of the machine 1 is described. It will be understood that the left-hand half of the machine 1 may be substantially identical.

The machine 1 comprises a supply roll 60 of unconverted tissue 10 that exits the supply roll 60 in the form of web 11. The web 11 is passed around tensioning roller 62 to a pair of embossing rollers 64. The embossing rollers 64 are a pair of steel matched cylinders which are engraved and structured to give a double-sided pattern when embossing. The skilled person will recognise that a steel on rubber combination may also be employed. Steel-steel gives a two sided imprint while steel-rubber give a single sided imprint to the web 11.

From the embossing rollers 64, the web 11 passes between brush spreader rollers 65, which spread the web 11 to remove wrinkles resulting from the embossing stage. The web 11 then enters the nip of calender rollers 66, which in the illustrated embodiment are set with a gap distance between the rollers 66 of between 0-33% of paper thickness, to calender the now embossed web 11 to a thickness comparable to the initial thickness prior to embossing.

From the calender rollers 66, the web 11 proceeds to a perforating roller 3 at the outlet of the converting machine 1, where it is partially cut to define individual tissue lengths. At this point, the first web 11 from the right-hand half of the machne1 is combined with the second web12 from the left-hand half of the machine, which is partially cut around perforating roller 4.

The two webs 11, 12 after passing around perforating rollers 3, 4, are folded together at interfolder 6. The tissue 10 coming from the respective webs 11, 12 is folded together in Z-formation, with folds of the respective webs 11, 12 interleaved together as is otherwise well known in the art. The partial cuts are offset from each other in the respective webs such that the folded tissue web is continuous and, when drawn from a dispenser, tissues from each web will be dispensed alternately. The folded tissue 10 is collected as a stack 14 in stacking station 8 until the stack reaches an uncompressed height H1, which in this case is around 130 mm. The stack 14 has a stack width W, which in this case is around 85 mm, being a standardized dimension for use in certain tissue dispensers. These dimensions can of course be adjusted according to the tissue material, the process and/or the required end use.

Figure 2:
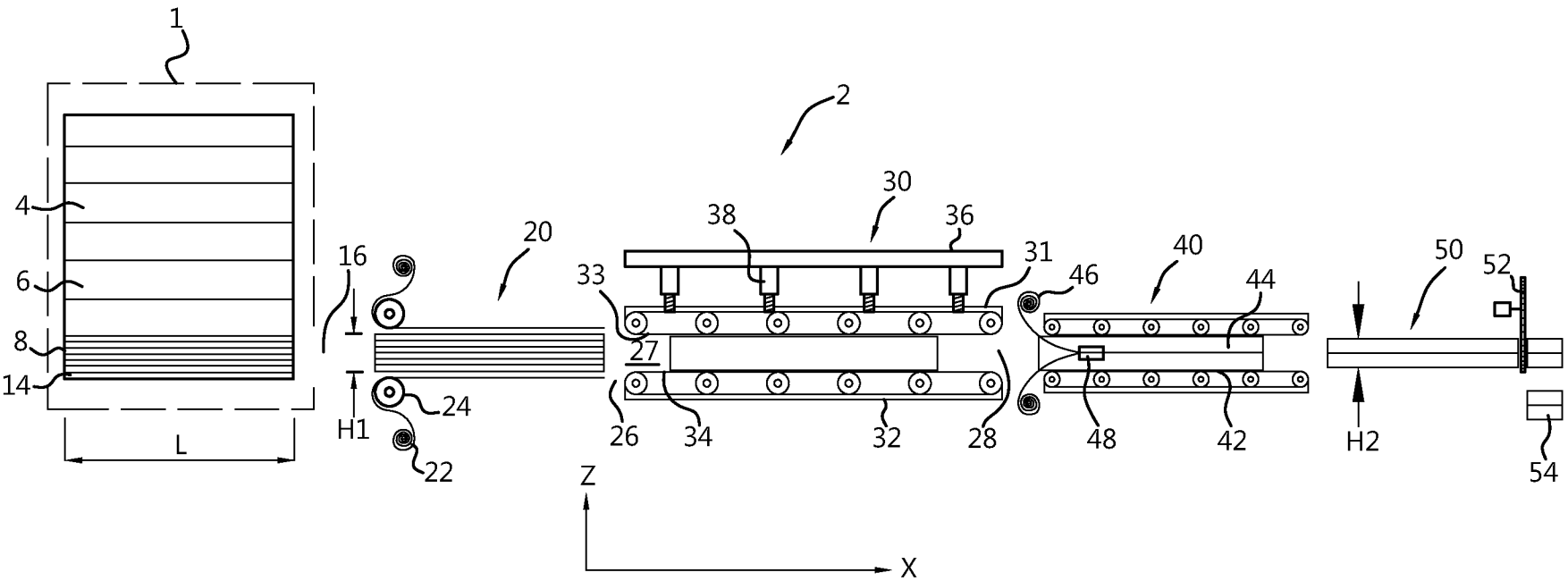
FIG. 2 is a schematic view of the conversion machine of FIG. 1 and a packaging system of the invention.

FIG. 2 is a schematic view in the direction II of FIG. 1, in the process direction of the converting machine 1. According to FIG. 2, the perforating roller 4 is shown above the interfolder 6 and the stacking station 8. The tissue webs 11, 12, and the converting machine 1 all have an effective width L, which defines the length of the stack 14. In the present embodiment, this length L is 2200 mm although the skilled person will understand that this is a variable that will be determined by the machine and/or the end use.

Aligned with the stacking station 8, is a packaging system 2 for packaging of the converted tissue produced by the converting machine 1. The packaging system 2 comprises a number of apparatus arranged in sequence in a transport direction X and aligned with the stacking station 8 for handling and packaging of the stack 14 in an effectively continuous process. It will be understood that the converting machine 1 and packaging machine 2 are both complex installations having many more components that are neither shown nor discussed as they are otherwise not relevant to the present invention.

Aligned with an outlet 16 of the converting machine 1, there is an attachment applying apparatus 20 comprising a supply of attachment elements 22 and application heads 24. The attachment applying apparatus 20 is in turn aligned with an input end 26 of compression apparatus 30. Compression apparatus 30 includes first and second opposed compression members 31, 32, which define a compression path 27, each of which carries respective first and second transport surfaces 33, 34. The first compression member 31 is mounted to be movable in a vertical direction Z and an actuator mechanism 36 comprising a plurality of actuators 38 is arranged for moving the first compression member 31 towards and away from the second compression member 32.

An outlet end 28 of the compression apparatus is aligned with a bander apparatus 40 having a transport path 42 for a compressed log 44 and which is provided with a supply of wrapping web 46 and an adhesive applicator 48. The bander apparatus 40 is in turn aligned with a saw station 50, comprising an otherwise conventional circular saw 52, arranged to cut individual bundles 54 from the log 44. The log 44 has a final height H2, which is significantly less than the uncompressed height H1.

Operation of the packaging system 2 in the packaging of tissue bundles according to the invention will now be described with reference to FIG. 2.

A tissue stack 14 is collected in the converting machine 1 until the stack 14 reaches an uncompressed height H1, at which point the tissue webs 11, 12 are broken and the stack 14 is moved out of the outlet 16 and into the attachment applying apparatus 20. As indicated above, additional rollers, grippers, guides, sensors, actuators, drives and transport provisions will be present to facilitate this movement. Such provisions are conventional and are not further discussed in this context.

As the tissue stack 14 passes in the transport direction X through the attachment applying apparatus 20, the uppermost tissue and the lowermost tissue of the stack 14 are engaged by application heads 24, which apply attachment elements 22 to these surfaces. The attachment elements 22 are provided on a continuous attachment strip having a self-adhesive surface that adheres to the tissue material. In this embodiment, the attachment elements 22 on the upper and lower surfaces of the stack 14 are identical hook and eye type fasteners, such that there will be no need to orientate a bundle 54 in use.

From the attachment applying apparatus 20, the stack 14 proceeds in the transport direction X to the compression apparatus 30 and enters the compression path 27 via the inlet end 26. In order that the stack 14 can enter the compression path 27, the first compression member 31 must be spaced from the second compression member 32 by a spacing that is greater than the uncompressed height H1 of the stack 14. To this purpose, the actuators 38 have been operated to withdraw the first compression member 31 in the Z direction.

Once the stack 14 is completely within the compression path 27, the actuators 38 are operated to move the first compression member 31 in the Z direction towards the second compression member 32. This movement proceeds until the first compression member 31 is spaced from the second compression the actuators 38 may be operated to move the first compression member 31 until a certain pressure is achieved. This pressure may be around 160 kN/m$^2$, according to requirements. The spacing at this time may be less than H2, allowing for some spring back of the tissue material once the pressure is removed. During the compression stroke, the respective first and second transport surfaces 33, 34 move the stack 14 along the compression path 27 from the inlet end 26, to the outlet end 28. Once compressed in this state, the stack 14 is referred to in the following as a log 44.

On exiting the outlet end 28 of the compression apparatus 30, the log continues to move in the transport direction Z into the bander apparatus 40. The bander apparatus 40 may be otherwise conventional apart from its adaptation to handle relatively highly compressed logs. The log 44 leaving the compression path 27 has a tendency to recover to a greater height and the transport path 42 through the bander apparatus 40 must maintain this compression until the wrapping web 46 has been applied. The wrapping web 46 is applied around the log 44 from upper and lower web dispensers as a two-part wrapper, joined to each other along a longitudinal seam by a hot-melt adhesive. It will be understood that a one-part wrap-around wrapper could alternatively be used. The wrapper material is of surface weight 110 gsm virgin paper and somewhat stronger than a wrapper conventionally used for loose bundles of similar weight.

The wrapped log 44 on exit from the bander apparatus 40 has a final height H2 of around 100 mm and a final density of around 35 g/cm$^3$. At this value, the tissue material is still viable and once dispensed has all of the properties expected of it and from a user perspective is identical to tissue material exiting the conversion machine 1. The log 44 no longer needs to be maintained in compression since the wrapping web 46 prevents expansion. The log 44 proceeds to saw station 50 where circular saw 52 cuts individual bundles 54 from the log 44. This portion of the operation may take place offline or out of line with the other operations of the packaging system 2. In particular, the saw 52 may require intermittent advancement of the log 44, while the log 44 may proceed at a constant speed through the attachment applying apparatus 20, the compression apparatus 30 and the bander apparatus 40.

It will be recognized that while the invention has been described by reference to the embodiments discussed above these embodiments are susceptible to various further modifications and alternative forms well known to those of skill in the art, without departing from the spirit and scope of the invention. Accordingly, although specific embodiments have been described, these are examples only and are not limiting upon the scope of the invention.

The invention claimed is:

1. A method of processing structured tissue material to form a compressed bundle of folded tissues, the method comprising:

providing a web comprising at least one ply of structured tissue;

at least partially destructuring the at least one ply of structured tissue;

folding the web with itself or with another similar web to form a stack;

compressing the stack at a compression of greater than 120 kN/m$^2$ to form a compressed bundle of folded tissues having a density of greater than 0.2 g/cm$^3$; and wherein destructuring takes place by embossing and calendering the at least one ply of structured tissue, and wherein calendering takes place subsequent to embossing.

2. The method according to claim 1, wherein embossing takes place at a pressure of from 15,000 N/mm$^2$ to 25,000 N/mm$^2$.

3. The method according to claim 1, wherein calendering takes place by setting a nip between calender rollers, wherein the nip is from 0.1 to 0.02 mm.

4. The method according to claim 1, further comprising spreading the web subsequent to destructuring to remove wrinkles.

5. The method according to claim 1, wherein the web has a weight of between 10 gsm and 65 gsm.

6. The method according to claim 1, wherein the web comprises further plies of tissue material.

7. The method according to claim 1, wherein the web is partially cut or perforated into sheets prior to being folded.

8. The method according to claim 1, wherein the web is folded in an interleaved fold configuration.

9. The method according to claim 1, wherein the stack has a width of between 70 mm and 100 mm.

10. The method according to claim 1, wherein the stack has a length of between 1.5 m and 2.5 m.

11. The method according to claim 1, wherein destructuring and folding take place in a tissue conversion machine in a continuous process and the stack is subsequently delivered to a compression station for compression of the stack.

12. The method according to claim 1, further comprising delivering the compressed bundle to a bander station and wrapping the bundle in a wrapping web to form a wrapped bundle.

13. The method according to claim 12, wherein the wrapped bundle is in the form of an elongated log and the method further comprises sawing the log into a plurality of individual tissue packages.

14. The method according to claim 1, wherein the structured tissue is a three-dimensionally structured tissue paper web.

15. The method according to claim 1, wherein the structured tissue material is a Through-Air-Dried material, an Uncreped-Through-Air-Dried material, an Advanced-Tissue-Molding-System material, a New Tissue Technology material, or a combination of any of these materials.

* * * * *